US005143136A

United States Patent [19]

John

[11] Patent Number: 5,143,136

[45] Date of Patent: Sep. 1, 1992

[54] CLIP ASSEMBLY FOR VERTICAL LOUVERS

[75] Inventor: Julius F. John, Redondo Beach, Calif.

[73] Assignee: Home Fashions, Inc., Santa Monica, Calif.

[21] Appl. No.: 749,429

[22] Filed: Aug. 23, 1991

[51] Int. Cl.[5] ..... E06B 9/30

[52] U.S. Cl. ..... 160/173; 160/178.1; 24/335; 24/461

[58] Field of Search ..... 160/173, 178.1, 168.1, 160/900, 178.3; 24/330, 329, 335, 115 H, 461, 462

[56] References Cited

U.S. PATENT DOCUMENTS

| | | | |
|---|---|---|---|
| 2,310,086 | 2/1943 | Howard . | |
| 2,405,255 | 8/1946 | Horton | 160/173 |
| 2,521,151 | 9/1950 | Cusick | 160/168.1 |
| 2,700,803 | 2/1955 | Graham . | |
| 2,756,817 | 7/1956 | Toti | 160/173 |
| 3,191,241 | 6/1965 | Johnson . | |
| 3,371,446 | 3/1968 | Minds, Jr. . | |
| 3,916,973 | 11/1975 | Schuppler et al. | 160/178.3 |
| 4,267,875 | 5/1981 | Koks . | |
| 4,407,350 | 10/1983 | Nakamura | 160/178.1 |
| 4,529,025 | 7/1985 | Oskam . | |
| 4,696,336 | 9/1987 | Dixon | 160/178.1 |
| 4,913,214 | 4/1990 | Ming . | |
| 4,913,216 | 4/1990 | Lemay | 160/166.1 X |

FOREIGN PATENT DOCUMENTS

| | | | |
|---|---|---|---|
| 3303715 | 8/1984 | Fed. Rep. of Germany | 160/178.1 |
| 7609987 | 3/1978 | Netherlands | 160/178.1 |

*Primary Examiner*—David M. Purol

*Attorney, Agent, or Firm*—Wallenstein Wagner & Hattis, Ltd.

[57] ABSTRACT

A clip assembly (20,100) for use in combination with a blind assembly having a plurality of free-hanging elongated vertical louvers (10) for preventing the louvers from tangling is disclosed. The clip assembly comprises a plurality of clips (20) spaced apart and attached to a cord (100). Each clip (20) is attached to a portion of a louver (10) adjacent a side edge (12).

14 Claims, 2 Drawing Sheets

CLIP ASSEMBLY FOR VERTICAL LOUVERS

DESCRIPTION

1. Technical Field of the Invention

The present invention relates to venetian blind systems that are used as decorative fixtures for window coverings and, more particularly, to a clip assembly for attachment to the lower portion of each vertical louver to prevent the louvers from tangling and overlapping in an undesirable manner.

2. Background of the Invention

Today, there are a variety of blinds available in the market to cover windows or to partition spaces. Venetian blinds are very popular and comprise a plurality of spaced vertical louvers. The louvers are attached to a mechanism adjacent their tops for lateral movement between open and closed positions and for rotational movement to open and closed positions. An example of such a mechanism for vertical blinds is disclosed in U.S. Pat. No. 4,834,162, entitled VERTICAL LOUVER BLIND OPERATING MECHANISM and assigned to the Assignee of the present invention, HOME FASHIONS, INC. of Santa Monica, Calif.

The louvers are free-hanging in that they are not maintained and held in position at their bottoms by an attached mechanism. As such, during lateral movement and rotational movement or during a breeze, the lower portions of the louvers can tangle or overlap in an undesirable manner. To prevent such occurrences, manufacturers of venetian blinds sometime attach a chain to the lower portion of the louvers. Attachment is usually by permanent means such as by punching a hole in each louver, by a staple or by a permanent adhesive. Similarly, others attach weights to the base of each louver or use complicated mechanical attachments.

Clip structures are disclosed in the prior art. For example, each of the following patents disclose a clip assembly to be used with a louver: U.S. Pat. Nos. 4,696,336 (Dixon); 4,913,214 (Ming); and, 3,916,973 (Schuppler et al.). However, these clips appear to be either complicated or of questionable gripping strength or they require piercing the louver.

In designing a vertical louver assembly, many diverse considerations must be taken into account. For example, of primary concern is that the venetian blinds must be easy to assemble and disassemble for a consumer, both during the initial mounting and during cleaning or maintenance. People unskilled in the construction art must be able to do these tasks without any concern or hesitancy. To this end, the attachments and components of the assembly cannot be too complicated. In a modular system, a minimum number of parts is both preferred and desired. Further, the connections for the parts need to be simple, non-hazardous and uncomplicated. In addition, to comfortably put the system together and take it apart, it is advantageous to make the assembly so that it can be assembled and disassembled without the need for tools. Also, it must be strong so that it can withstand moves and any accidental dislodgings. Further, the entire assembly must be pleasing to viewers from all angles in front, in back and to the side of it.

Finally, with respect to attaching the bottom portions of the free-hanging louvers, it is preferable to have a relatively simple, low profile system; one to which the eyes are not immediately drawn. Ideally, the attachments should be relatively easy to make, should be pleasingly integrated into the blinds and should not damage the individual louvers if caught on something or inadvertently pulled off the louvers.

SUMMARY OF THE INVENTION

According to a primary aspect of the present invention, a clip assembly for use in combination with a venetian blind is disclosed. The clip assembly includes a plurality of clips connected together by a single cord for preventing the louvers from tangling or becoming overlapped in the wrong direction when the blind is closed or when contacted by a wind, object or person. Each of the clips cooperates with the edging bead and frictionally engages a portion adjacent a side edge of the louver it is attached to. The clips are connected near the bottom of the louvers.

Each clip has (a) a generally U-shaped gripping portion that includes a base and two outwardly extending members that are resilient and that form a channel therebetween for cooperating with a portion of the louver, which includes the edging bead, received therebetween; and, (b) two generally resilient, substantially parallel posts extending outwardly from the base of the gripping portion, in a direction opposite that of the extending members, so as to form a cord channel therebetween for receiving and for gripping the cord.

According to another aspect of the present invention, both of the extending members are contoured so as to receive and substantially lock the edging bead therebetween and prevent lateral movement of the clip relative to the vertical louver. To prevent longitudinal movement, the extending members further have complimentary extensions projecting from the surfaces that face the other extending member that extend generally towards the other extending member forming an off-set in the louver channel and two sharp edges for enhancing the gripping of the louver portion adjacent the longitudinal side edge and longitudinal edging bead of the louver.

According to still another aspect of the present invention, one of the posts has a transverse cord trough substantially perpendicular to the cord channel for receiving the cord; the other post has a projection for engaging the cord projecting generally towards the cord trough.

Preferably, the clips are unitary, one piece, and are constructed of plastic. Also, the cord channel can be sonically welded closed.

According to still another aspect of the present invention, the cord connecting adjacent clips has a length between each clip equal to or greater than the preselected, spaced distance between the louvers.

Other advantages and aspects of the invention will become apparent upon making reference to the specification, claims, and drawings to follow.

DETAILED DESCRIPTION OF THE INVENTION

Figure 1:
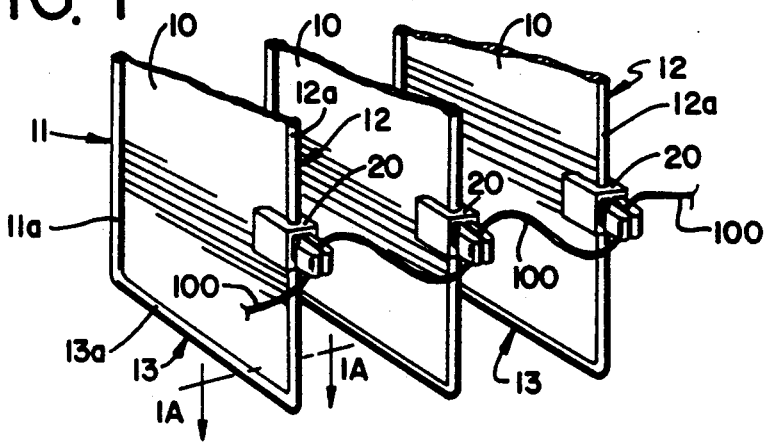
FIG. 1 is a perspective back side view of a portion of some louvers and the clip assembly made in accordance with the teachings of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows a portion of a venetian blind or vertical louver assembly. Three vertical elongated louvers 10 shown. Typically, such louvers 10 are made of vinyl. They are normally spaced apart by a preselected distance and attached at their tops or upper ends (not shown) to a mechanism that permits them to move laterally, i.e., closer together, and permits each to rotate about a generally central longitudinal axis. In practice, these louvers are equidistance from longitudinal center to longitudinal center. This distance between centers is about 3⅛" and each louver has a width of about 3½". These louvers are also free-hanging in that their bottoms or lower ends are not captured, namely, being supported or held into position, like the upper ends, by an outside mechanism. Accordingly, the louvers hang in substantially vertical positions in spaced, parallel relation to one another.

Figure 1A:
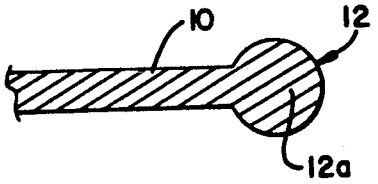
FIG. 1A is a sectional view of a portion of a louver having a longitudinal edging bead along line 1A—1A of FIG. 1.

Each louver 10 has a front side edge 11, the side facing the room, and a back side edge 12, the side facing the window. The louvers of FIG. 1 are shown rotated to their open position. In the closed position, the louvers partially overlap one another to prevent light from passing therebetween. Viewed outwardly from the room, the louvers 10 rotated to the closed position expose only their front side edges 11; the back side edges 12 are covered by the overlapping of each's adjacent louver. For added strength and aesthetics, a longitudinal edging bead **11*a*, 12*a* and a bottom edging bead 13*a* are constructed adjacent or into the front side edge 11, the back side edge 12 and the bottom edge 13, respectively. A sectional of the construction of the louver 10 and the longitudinal edging bead 12*a* for the back edge 12 is shown in FIG. 1A**. The bead, in fact, becomes the side or the bottom edge.

Clips 20 are individually attached to the louvers 10 to prevent the louvers from tangling or improperly overlapping when they are moved laterally or are rotated or when they are blown by the wind or inadvertently bumped by a person or object. A single clip 20 is releasably connected to a portion of the louver adjacent the back side edge 12 above the bottom edge 13. In particular, each clip 20 communicates with and clamps a portion of the louver adjacent the back side edge 12 and substantially encase a portion of the longitudinal edging bead **12*a*. Each clip 20 is further connected to a cord 100**.

Figure 2:
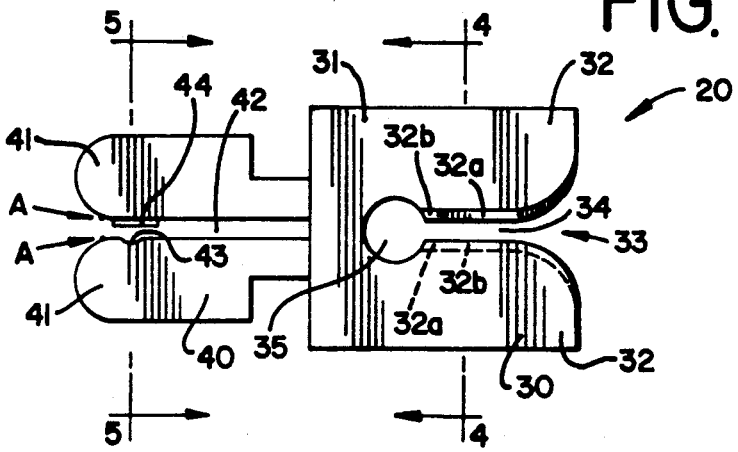
FIG. 2 is top view of one of the clips shown in FIG. 1.
Figure 3:
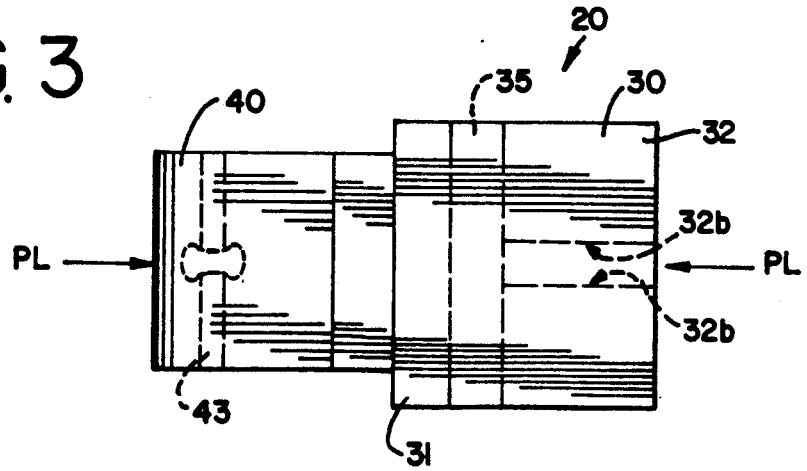
FIG. 3 is a side view of the clip shown in FIG. 2.

Turning to FIGS. 2 and 3, each clip 20 is constructed so as to have two parts, namely, a gripping portion 30 for engaging and gripping the section of the louver adjacent the back longitudinal edge 12 of the louver 10 and an integral head portion 40 for clamping the connecting cord 100 therein. The gripping portion 30 is generally U-shaped, having a base 31 and two outwardly-extending members 32 that form a channel 33 therebetween for cooperating with the edging bead **12*a* and for frictionally engaging and gripping the portion of the louver 10 adjacent the bead 12*a* that are received therebetween. The channel 33 formed between the two extending members 32, that generally follow the contour of the edging bead 12*a* and the portion of the louver 10 adjacent the edging bead being gripped, comprises two sections, the louver channel 34 and the bead channel 35**.

Figure 4:
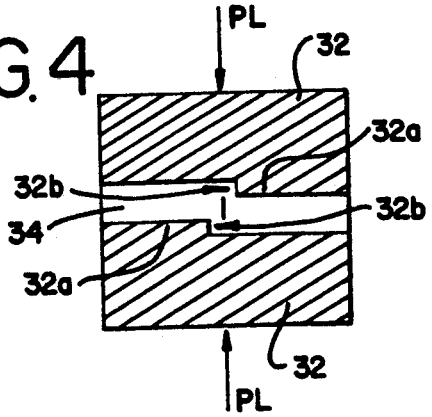
FIG. 4 is a sectional view along line 4—4 of FIG. 2.

The clip 20 is either snapped or slid into place on the louver 10. Once in position, the channels 33, 34, 35 between the closely contoured extending members 32 of the clip 20 substantially prevent the clip from inadvertently moving or sliding in a direction transverse to the louver 10. To prevent the clip 20 from inadvertently moving or sliding along the edge 12 of the louver 10 or in a direction longitudinal to the vertical louver, an off-set is constructed into the louver channel 34 formed between the extending members 32. Specifically, the inwardly facing surfaces of the extending members 32, being the surface closest to the other member 32 and the louver channel 34, have complimentary extensions **32*a*. Shown in FIG. 4, one extension 32*a* begins at the top of the extending member 32 and continues to about the middle of the member 32 and the other extending member's 32 extension 32*a* begins at about the middle and continues to the bottom of the member 32. Consequently, sharp edges 32*b* are formed into the extending members 32**.

Both extensions **32*a* begin at about the center, the parting line PL, of the clip 20. Since the clip 20** is preferably made of plastic, as by a molding process, a parting line PL is formed in the piece. Consequently, all of the elements of the clip are oriented and designed so as to facilitate the making and enhance the strength of the clip.

This off-set in the louver channel 34 and the two sharp edges **32*b* formed by the two complimentary extensions 32*a* enhances the gripping force or bite of the clip 20 onto the louver 10. The two sharp edges 32*b* act as teeth that bite into the louver 10 and tightly hold the louver. However, the bite is not so great as to mar, deface or deform the louver 10**.

Figure 6:
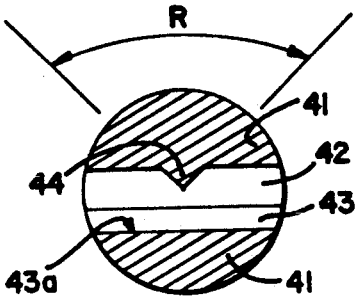
FIG. 6 is a magnified view of a portion of the clip shown in FIG. 5.
Figure 5:
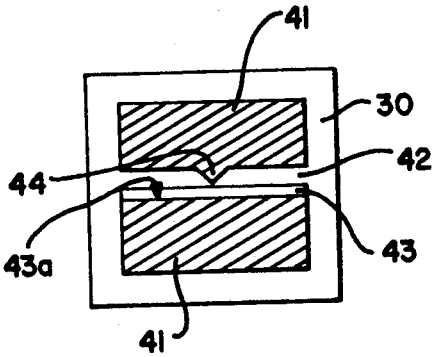
FIG. 5 is a sectional view along line 5—5 of FIG. 2.

The head portion 40 of the clip 20 comprises two substantially parallel posts 41 extending outwardly from the base 31 of the gripping portion 30 in a direction opposite that of the two extending members 32. A cord channel 42 is formed between the two posts 41 for receiving and for clamping the cord 100. One of the posts 40 has a transverse cord trough 43 formed in its inwardly facing surface, being the surface closest to the other post 41 and the cord channel 42, that faces and is substantially perpendicular to the cord channel 42. This transverse cord trough 43 receives the cord 100. The other post 41 has a centrally located projection 44 extending outwardly from its inwardly facing surface in a position substantially opposite and projecting towards the transverse cord trough 43 for engaging the cord 100. The details of these components are shown in FIG. 6. The side walls of the projection 44 intersect at an angle R which is preferably about 90°.

Thus, the cord 100 is secured into the head portion 40 of the clip 20 by sliding the cord into the cord channel 42 and into the cord trough 43. The projection 44 frictionally engages the cord 100 and pushes the cord into the base **43*a* of the trough 43** to substantially lock the cord into place.

To further lock the cord 100 into the head portion 40 of the clip 20, the two posts 41 can be pinched closed and sonically welded together by conventional means at points A (FIG. 2).

Referring back to FIG. 1, the cord 100 connects adjacent clips 20. This cord 100 preferably has a length between each clip 20 equal to or greater than the preselected, spaced distance between the longitudinal centers of the louvers. In practice, this distance is about 3⅛". Thus, the cord 100 is not tight, but has some slack. When a wind blows the louvers or the louvers are inadvertently nudged, the cord attached to each louver by a clip prevents the louvers from tangling or overlapping in the wrong direction.

The assembly typically includes nine clips equally spaced apart and attached to a single cord. The clips are generally thin so as to not take up a lot of space. However, they are also constructed, both as to size and materials, to be strong, in that breakage is undesirable. In addition, the gripping portion of the clip is preferably kept short so that when the louvers are rotated to the closed position, the clips, that are secured to the back edge, are not visible from the front. In short, the overlap of adjacent louvers covers the clips. As noted previously, the clips are removable and easily replaceable. Thus, if a clip breaks, the clip or the entire assembly of the clips and the connecting cord can be easily removed and replaced.

It is appreciated that the clips can take on different shapes, if desired, to more closely follow the style of the venetian blinds. Further, the clips and cord can be colored to a desired color. Finally, while the assembly has been described as having a clip attached to the back side edge of all of the louvers in a venetian blind, it is appreciated that at times, clips may not be desired on all of the louvers. For example, it may be desired to not attach clips to the outermost louvers. In addition, there might be times that it is desired to clip the front side edges of the louvers alone or together with the back side edges of the louvers.

I claim:

1. A clip assembly in combination with a blind assembly, the blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position; each said louver having a bottom edge, and a front and a back longitudinal edge and being laterally sized so that the front edge of each louver overlaps the back edge of the next adjacent louver in the closed louver position, the clip assembly comprising:

a plurality of clips, each said clip being attached to a portion adjacent an edge of one said louver; and, a cord connecting adjacent clips having a length between each clip equal to or greater than the preselected, spaced relations between the louvers, each said clip having a generally resilient gripping portion for engaging and gripping said portion of the louver adjacent said one edge of the louver, said gripping portion including two extending members forming a louver channel therebetween for receiving said portion, and an integral head portion for clamping said cord therein, said head portion including two posts extending outwardly from said gripping portion in a direction substantially opposite that of said two extending members forming a cord channel therebetween for receiving said cord.

2. The clip assembly as defined in claim 1, wherein the extending members have complimentary extensions forming an off-set in said louver channel and two edges for enhancing the gripping.

3. A clip assembly in combination with a blind assembly, the blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position; each said louver having a bottom edge, and a front and a back longitudinal edge and being laterally sized so that the front edge of each louver overlaps the back edge of the next adjacent louver in the closed louver position, the clip assembly comprising:

a plurality of clips, each said clip being attached to a portion adjacent an edge of one said louver; and, a cord connecting adjacent clips having a length between each clip equal to or greater than the preselected spaced relations between the louvers, each said clip having a generally resilient gripping portion for engaging and gripping said portion of the louver adjacent said one edge of the louver, said gripping portion including two extending members forming a louver channel therebetween for receiving said portion, said extending members having complimentary extensions forming an offset in said louver channel and two edges for enhancing the gripping, and an integral head portion for clamping said cord therein, said head portion including two extending posts forming a cord channel therebetween for receiving said cord, one said post having a transverse cord trough substantially perpendicular to said cord channel for receiving said cord and said other post having a projection projecting generally towards said trough for engaging said cord.

4. The clip assembly as defined in claim 3, wherein the clip assembly is constructed of plastic and said cord channel is sonically welded closed.

5. A clip assembly in combination with a blind assembly, the blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position, each said louver having front and back longitudinal edges with an edging head adjacent one said longitudinal edge and the louvers being laterally sized so that the front edge of each louver overlaps the back edge of the next adjacent louver in the closed louver position, the clip assembly comprising:

a plurality of clips, each said clip cooperating with the edging bead and engaging a portion adjacent the edging bead of one said louver; and, a cord connecting adjacent clips having a length between each clip equal to or greater than the preselected, spaced relations between the louvers, each said clip having a generally U-shaped gripping portion having a base and two contoured outwardly extending members forming a channel therebetween for both receiving the edging bead and for frictionally engaging said portion adjacent the edging bead of the louver received therebetween and two substantially parallel posts extending outwardly from said base of said gripping portion in a direction substantially opposite that of said two extending members forming a cord channel therebetween for receiving and for frictionally engaging said cord.

6. The clip assembly as defined in claim 5, wherein said extending members have complimentary extensions forming an off-set in said louver channel and two edges.

7. A clip assembly in combination with a blind assembly, the blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position, each said louver having front and back longitudinal edges with an edging bead adjacent one said longitudinal edge and the louvers being laterally sized so that the front edge of each louver overlaps the back edge of the next louver in the closed louver position, the clip assembly comprising:

a plurality of clips, each said clip cooperating with the edging bead and engaging a portion adjacent the edging bead of one said louver; and, and a cord connecting adjacent clips having a length between each clip equal to or greater than the preselected, spaced relations between the louvers, each said clip having a generally U-shaped gripping portion having a base and two contoured outwardly-extending members forming a channel therebetween for both receiving the edging bead and for frictionally engaging said portion adjacent the edging bead of the louver received therebetween, said extending members having complimentary extensions forming an offset in said louver channel and two edges and two substantially parallel posts extending outwardly from said base of the gripping portion forming a cord channel therebetween for receiving and for frictionally engaging said cord, one said post having a transverse cord trough substantially perpendicular to said cord channel for receiving said cord and said other post having a projection generally towards said trough for engaging said cord.

8. The clip assembly as defined in claim 7, wherein said clip assembly is constructed of plastic.

9. The clip assembly as defined in claim 8, wherein said cord channel is sonically welded closed.

10. A clip in combination with a blind assembly, the blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position, each said louver having opposed longitudinal edges with an edging bead adjacent both said longitudinal edges, each clip being connected to an adjacent clip by a cord having a length between each clip equal to or greater than the preselected, spaced relations between the louvers and each clip comprising:

a generally U-shaped gripping portion having a base and two contoured outwardly-extending members forming a channel therebetween for cooperating with one of the edging beads and a portion of the louver adjacent the one edging bead received therebetween and, two substantially parallel posts extending outwardly from said base of said gripping portion in a direction substantially opposite that of said two extending members forming a cord channel therebetween for receiving and for gripping the cord.

11. The clip as defined in claim 10, wherein said extending members have complimentary extensions forming an off-set in said louver channel and two generally facing edges for enhancing the gripping of said portion of the louver adjacent the one edging bead.

12. A clip in combination with a blind assembly, the blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position, each said louver having opposed longitudinal edges with an edging bead adjacent both said longitudinal edges, each clip being connected to an adjacent clip by a cord having a length between each clip equal to or greater than the preselected, spaced relations between the louvers and each clip comprising:

a generally U-shaped gripping portion having a base and two contoured outwardly-extending members forming a channel therebetween for cooperating with one of the edging beads and a portion of the louver adjacent the one edging bead received therebetween, said extending members having complimentary extensions forming an offset in said louver channel and two generally facing edges for enhancing the gripping of said portion of the louver adjacent the one edging bead, and two substantially parallel posts extending outwardly from said base of said gripping portion in a direction substantially opposite that of said two extending members forming a cord channel therebetween for receiving and for gripping the cord, one said post having a transverse cord trough substantially perpendicular to said cord channel and said other post having a projection for engaging said cord projecting generally towards said cord trough.

13. The clip as defined in claim 12, wherein said clip assembly is constructed of plastic.

14. The clip as defined in claim 13, wherein said cord channel is sonically welded closed.

* * * * *